US005121878A

United States Patent [19]

Wallin

[11] Patent Number: 5,121,878

[45] Date of Patent: Jun. 16, 1992

[54] METHOD OF ERECTING A CARTON BLANK, A TOOL FOR CARRYING OUT THE METHOD AND A CARTON BLANK USED WITH THE METHOD

[75] Inventor: Kay Wallin, Halmstad, Sweden

[73] Assignee: Sprinter System AB, Stockholm, Sweden

[21] Appl. No.: 753,950

[22] Filed: Sep. 3, 1991

Related U.S. Application Data

[62] Division of Ser. No. 435,408, Nov. 3, 1989, Pat. No. 5,059,165.

[30] Foreign Application Priority Data

Mar. 4, 1988 [SE] Sweden ..... 8800794

[51] Int. Cl.[5] ..... B65D 5/30

[52] U.S. Cl. ..... 229/195; 229/197

[58] Field of Search ..... 229/195, 197, 154

[56] References Cited

U.S. PATENT DOCUMENTS

| | | | |
|---|---|---|---|
| 377,640 | 2/1888 | Schmidt | 229/197 |
| 610,950 | 9/1898 | Smith | 229/195 |
| 690,496 | 1/1902 | Webb | 229/195 |
| 3,285,494 | 11/1966 | Baker | 229/195 |
| 3,400,877 | 9/1968 | Pierce, Jr. | 229/195 |
| 3,481,525 | 12/1969 | Pierce, Jr. | 229/195 |
| 3,556,384 | 1/1971 | Pierce, Jr. | 229/195 |

FOREIGN PATENT DOCUMENTS

| | | | |
|---|---|---|---|
| 212180 | 4/1967 | Sweden | 229/195 |
| 216447 | 10/1967 | Sweden | 229/195 |
| 925929 | 5/1963 | United Kingdom . | |
| 1119688 | 7/1968 | United Kingdom | 229/195 |

*Primary Examiner*—Gary E. Elkins

*Attorney, Agent, or Firm*—Ostrolenk, Faber, Gerb & Soffen

[57] ABSTRACT

The invention relates to a method of erecting a carton blank, a tool (15) for carrying out the method and a carton blank (1) used in the method. As the blank (1) is pressed down by means of a plunger (17) into a forming space (18), its end walls (5) are erected by solely their corner areas (9) being pressed towards opposing guide surfaces (19) arranged in the space (18), and are retained between these surfaces and bolsters (23, 24) projecting from the plunger simultaneously as, when the end walls (5) assume a substantially right angle relative the bottom (2), said walls also curve outwards due to the resiliency of the carton blank to form a convex shape for expanding and disposing at an oblique angle insertion openings (10) stamped out of the blank such as to enable easy and rapid insertion and locking of insertion flaps (8) on corresponding adjacent side walls (4) with the aid of locking tongues (11) in the insertion openings (10) for final positional fixation of the carton blank forming the carton tray in its ready-erected state. The tool is arranged to erect the blank with the aid of first, opposing guide surfaces (19) and second opposing guide surfaces (20) and a plunger (17) which can be pressed downwards into the space (18) such that the plunger presses the blank down while simultaneously locking the side and end walls (4, 5) of the blank to each other.

6 Claims, 4 Drawing Sheets

METHOD OF ERECTING A CARTON BLANK, A TOOL FOR CARRYING OUT THE METHOD AND A CARTON BLANK USED WITH THE METHOD

This is a division of application Ser. No. 07/435,408, filed Nov. 3, 1989, now U.S. Pat. No. 5,059,165.

The present invention relates to a method of erecting a carton blank, a tool for carrying out the method and a carton blank used with the method, this blank including a bottom with side and end walls which can be folded up along crease lines, projecting extensions in the form of corner flaps being provided on the side or end walls, such that when the blank is in an erected state these flaps can be locked with locking means on the respective side or end walls.

One object of the present invention is to provide a method, a tool and a carton blank of the kind mentioned in the introduction, such that very great capacity per time unit can be achieved in erecting the blanks into trays, simultaneously as this can be accomplished very simply and reliably by the tool not having any loose, moving parts which can cause trouble. There is thus also achieved the advantage that the tool operates very quietly, since there are no loose, mechanical devices which can make a noise. The essentially distinguishing features of the invention are disclosed in the following claims.

Figure 1:
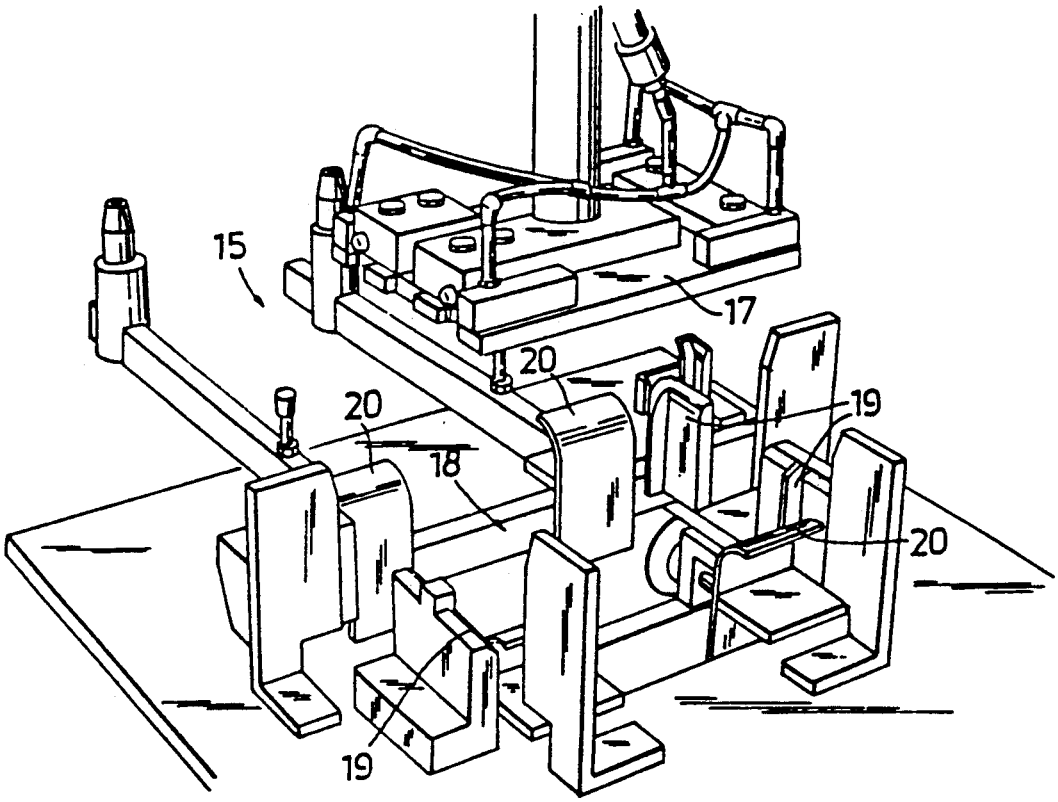
Figure 2:
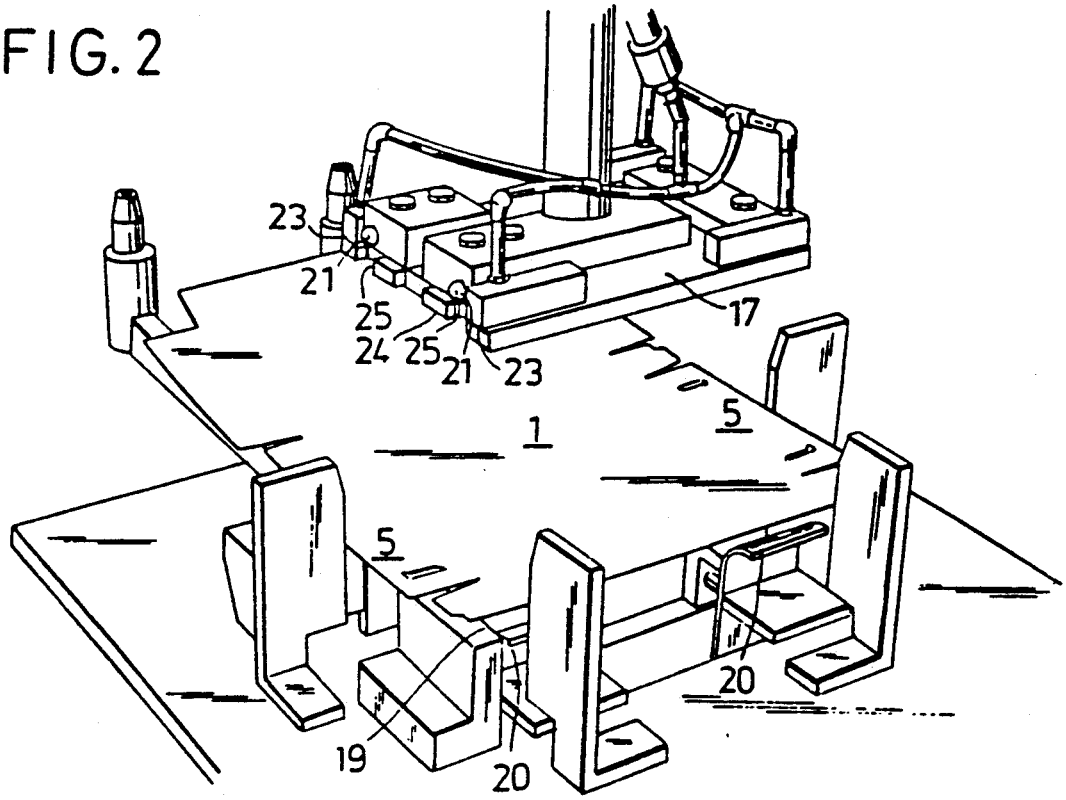
Figure 3:
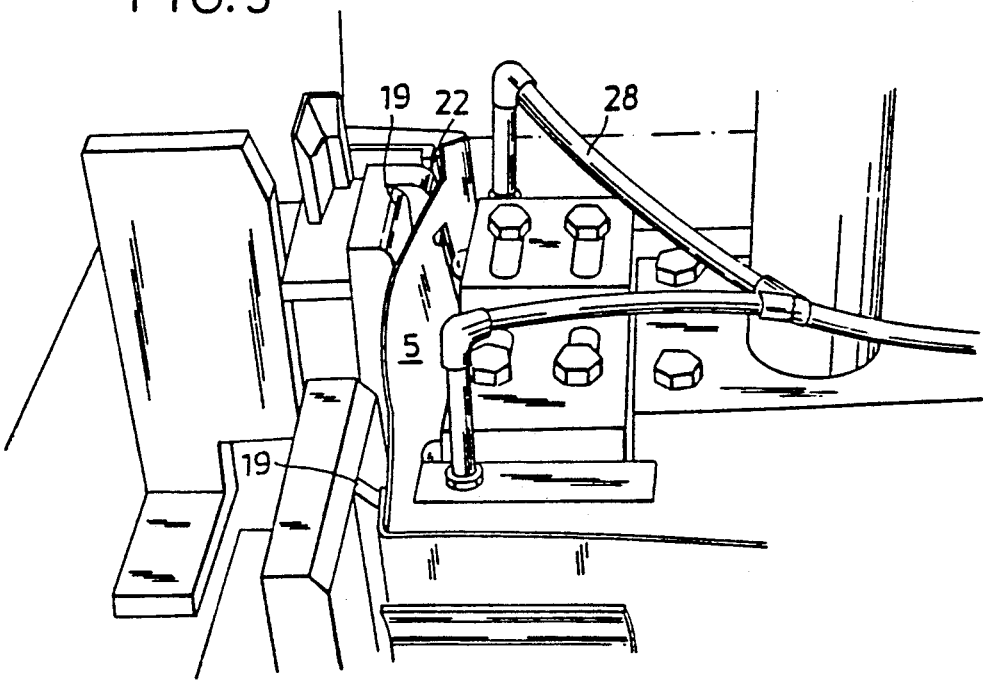
Figure 4:
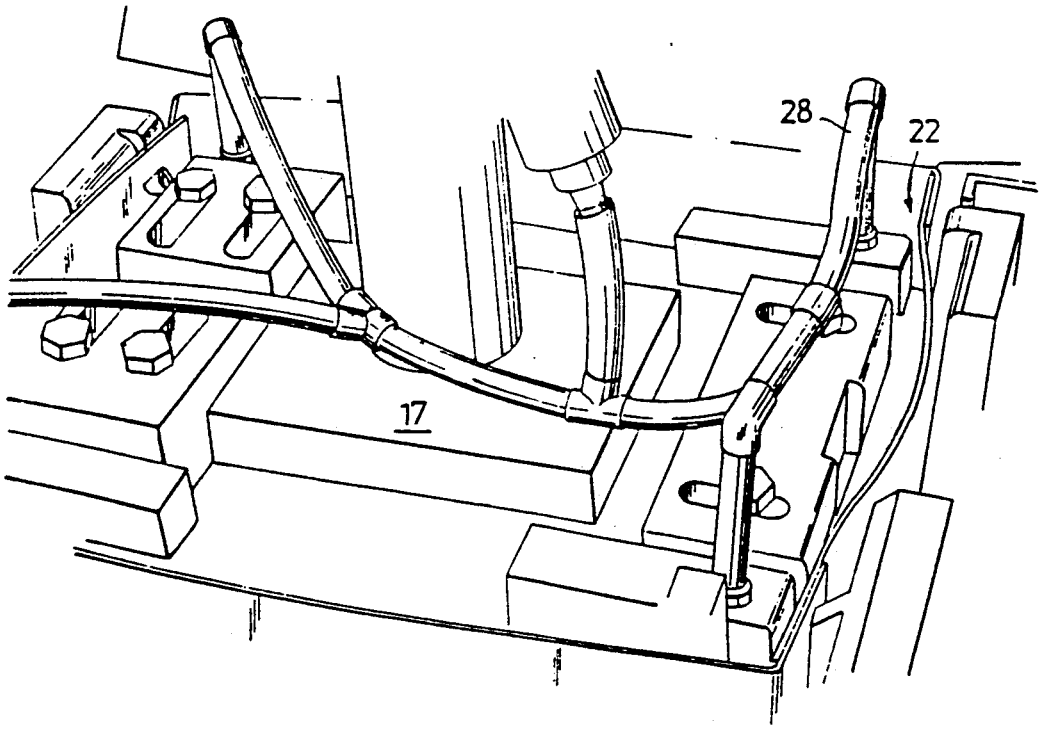

The invention will now be described in more detail with reference to the accompanying drawings, where FIG. 1 is a perspective view of a preferred embodiment of the tool in accordance with the present invention, FIG. 2 is a perspective view of the tool illustrated in FIG. 1, with a blank in accordance with the invention placed thereon and before a plunger associated with the tool is lowered for erecting the blank, FIG. 3 is a partial perspective view of the tool, from which it will be seen how an insertion flap on the blank is caused to lead into an insertion opening on the end wall, and where a spring loaded opener is used, FIG. 4 is a partial perspective view of the tool, from which it will be seen how an insertion flap on the blank is caused to lead into an insertion opening on the end wall, when an opener is not used.

Figure 5:
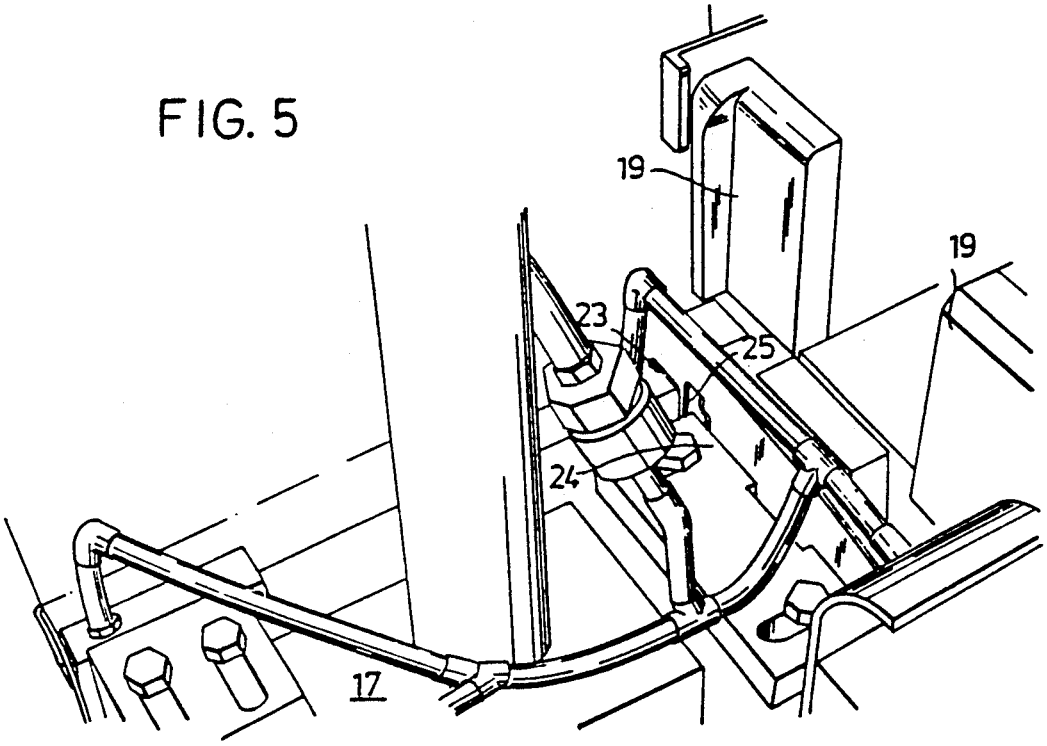
Figure 6:
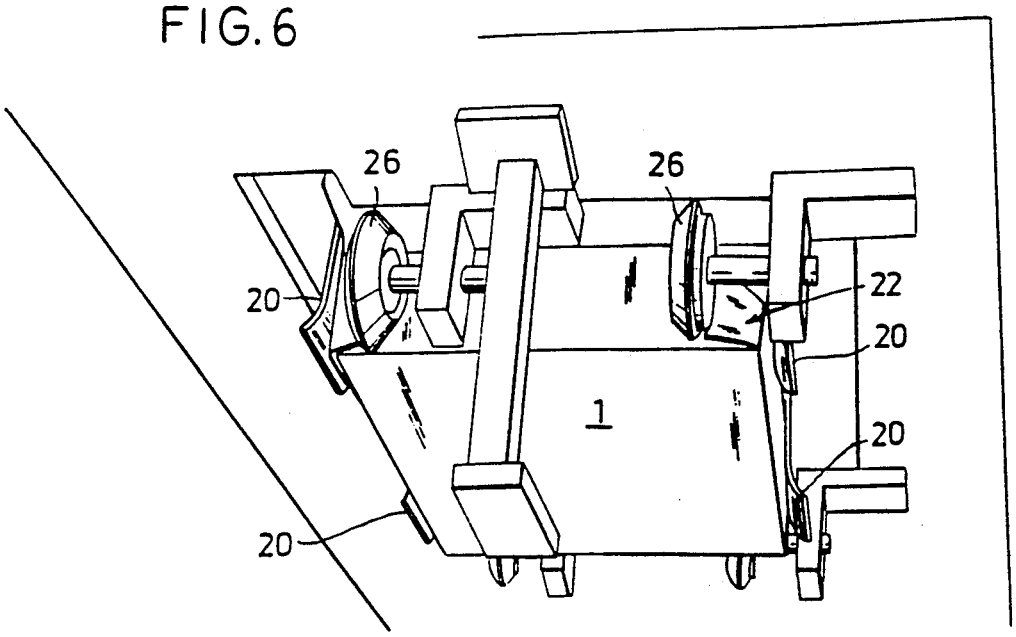
Figure 7:
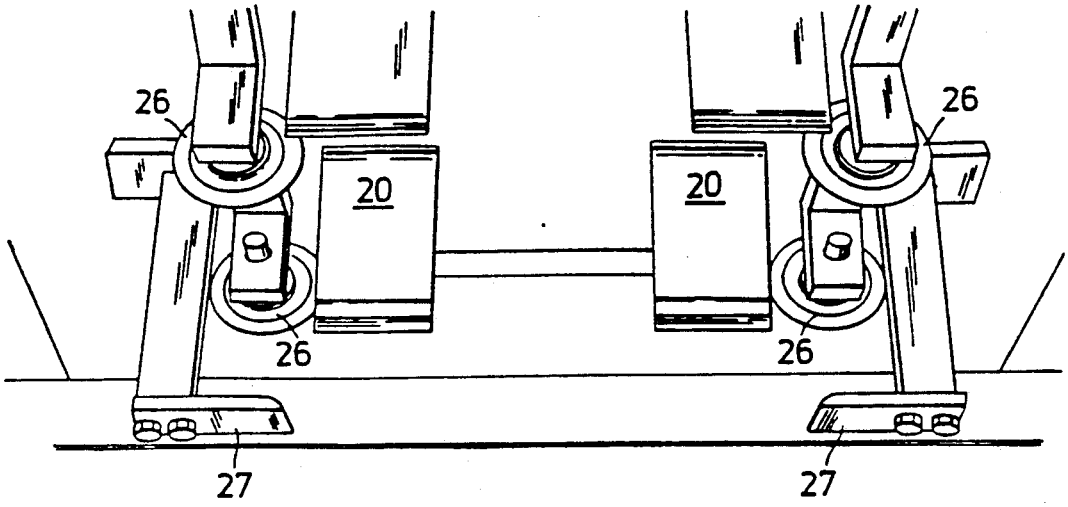
Figure 8:
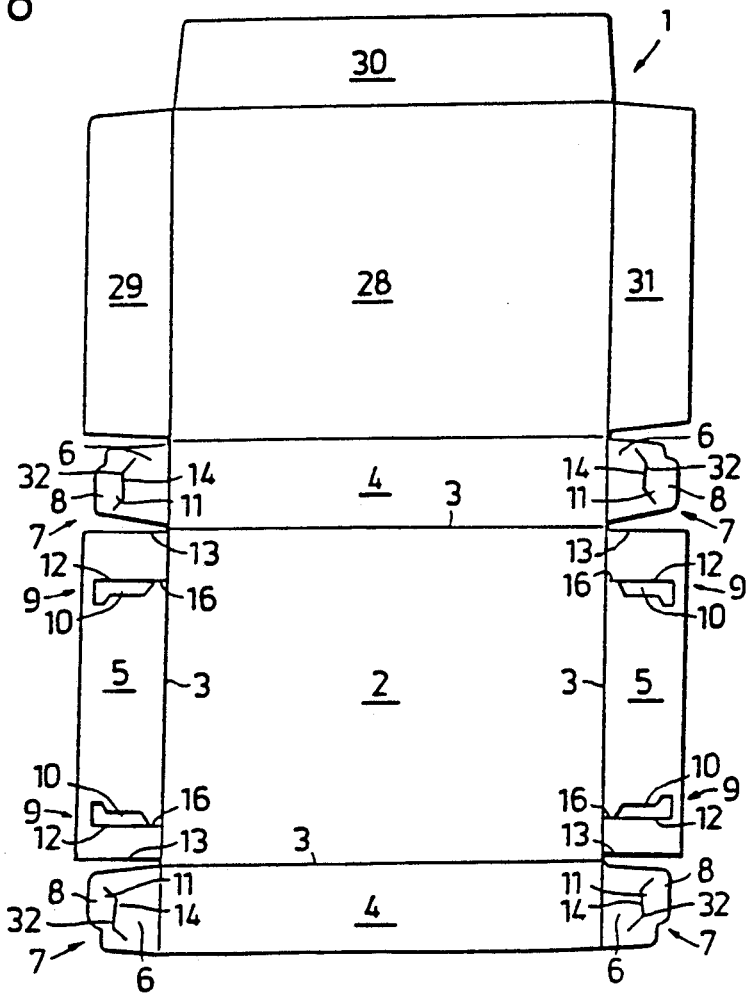

FIG. 5 is a partial perspective view of the tool, from which it will be seen the positioning of the bolsters on the plunger, locking rollers for pressing in the locking tongue on the insertion flaps being arranged to act between these rollers, FIG. 6 is a perspective view of the tool, seen obliquely from below, and illustrating the positioning of the locking rollers, FIG. 7 is a perspective view seen obliquely from below of the tool without a carton blank, and FIG. 8 is a development of a carton blank for erection by the method and with the tool in accordance with the invention.

A preferred embodiment of a tool in accordance with the present invention for erecting a carton blank 1 is illustrated in FIGS. 1–7, and a development of a preferred embodiment of the blank 1 in accordance with the present invention is illustrated in FIG. 8. As will be seen from FIG. 8, the blank 1 comprises a bottom 2 with side walls 4 and end walls 5 that can be folded up along crease lines 3, the side walls 4 being provided with projecting extensions in the form of corner flaps 6 which are lockable in an erected state by locking means 7 between the corner flap 6 and coating end wall 5. The locking means 7 comprises an insertion flap 8 with a locking tongue 11 formed on the respective corner flap 6, together with an insertion opening 10 in the corner area 9 of the coating end wall 5 when the blank 1 is erected. In the erected state the insertion opening 10 is vertically oriented and stamped out of the blank 1 such as to have an edge part 12 coating with the locking tongue 11. The insertion flap 8 is insertable in the insertion opening 10 and can be locked thereto with the aid of its locking tongue 11, which is adapted to snap past the edge part 12 and to hook thereon with its end edge 32, the edge part 12 defining the insertion opening 10 closest adjacent the outer end edge 13 of the end wall 5. The locking tongue 11 of the insertion flap 8 is formed by a slit 14, this slit being transverse the side wall 4, and provided with two "tails", giving it an S shape. Each insertion opening 10 is defined nearest the end edge of the end wall 5 by the edge part 12, which is vertical with the blank erected, and at a short distance from the bottom crease line 3 merges into a slit 16 extending to the crease line. When the blank is erected, the insertion opening 10 has a height corresponding to about ⅔ of the end wall 5 and a width amounting to about 3–5 mm along at least the greater part of the height of the end wall 5. The width of the insertion opening 10 may not fall below about 3 mm, mainly to ensure that the insertion flap 8 can be thrust therein during the erection of the blank 1. At the free end edge of the end wall 5 the insertion opening 10 may have an increased width of about 5–8 mm from the edge part 12 for facilitating thrusting into the insertion flap 8.

The tool 15 illustrated in FIGS. 1–7 includes a plunger 17, intended for pressing the carton blank 1 down into a forming space or mould 18 during simultaneous erection and positional fixation of the side walls 4 and end walls 5 of the tray. The mould 8 has first opposing guide surfaces 19 arranged for erecting the end walls 5 of the blank 1 so that in their substantially vertical position they assume an outwardly curving shape. There are also second opposing guide surfaces 20 for erecting the side walls 4 of the blank 1 simultaneously as its insertion flaps 8 become insertable in the insertion openings 10. For facilitating an oblique attitude and expansion of the insertion openings 10, the plunger 17 can be provided with spring loaded openers 21, as illustrated in FIGS. 2 and 3, but it is often sufficient for the corner regions 22 of the blank 1 to be restrained between the plunger 17 and the guide surfaces 19 for the resilience in the blank to give the end walls 5 the desired curvilinear shape for the oblique attitude and expansion of the insertion openings 10. The plunger 17 has at least one bolster 23, 24 on either side of a recess 25, these bolsters projecting out about 2 mm past the bottom 2 defined by the crease lines in the blank 1, whereby the insertion of the insertion flap 8 into the insertion opening 10 is facilitated. The recess 25 is adapted to receive the locking tongues 11 on the insertion flap 8, which can be inserted therein with the aid of locking rollers 26 during erection. The locking rollers 26 are arranged lower down in the mould 18, two on either side at the area where the end walls 5 are positionally fixed to the side walls. The corner areas 9 of the blank 1 are rolled over by the locking rollers 26 when the blank 1 is pressed downwards with the aid of the plunger 17, the locking tongues 11 being urged into the recesses 25 for locking the insertion flaps 8 in the insertion openings 10.

There are two scrapers 27 below the locking rollers 26 for retaining the tray against its upper edge when the plunger 17 has changed its direction in its bottom-most position and passes these on its way up again for collecting a new blank 1, the ready-erected tray then leaving the tool. For further facilitating removal of the tray, compressed air can be supplied via hoses 28 to the plunger 17.

Erection in accordance with the present invention of a carton blank 1 is carried out in the following manner. After a blank 1 has been advanced so that it lies in the tool 15, as illustrated in FIG. 1, the plunger urges the blank downwards into the mould 18. The end walls 5 are then erected with the aid of the first guide surfaces 19, as illustrated in FIGS. 3 and 4, so that the end walls 5 are given curvilinear shape. In this position the side walls 4 are erected with the already inwardly folded corner flaps 6 so that the insertion flaps 8 of the corner flaps can be inserted in the now vertically oriented and obliquely positioned insertion openings 10. When the insertion flaps 8 are completely inserted in the insertion openings 10, the plunger 17 urges the blank 1 further down into the mould 18, as will be seen from FIGS. 5 and 6, the locking rollers 26 then urging in the locking tongues 11 into hooked engagement with the vertical edge parts 12 of the insertion openings 10 while the bolsters 23 and 24 on the plunger 17 press against the locking tongues 11 and facilitate snapping them into position. The ready-erected tray is then pressed down and ejected by the two scrapers 27 under the tool 15.

As will be seen from FIG. 8, the blank 1 can be provided with a lid 28 with side flaps 29, 30 and 31, the lid being hinged at one side wall 4, and for closing the tray, e.g. by gluing, the flaps 29, 30 and 31 can be sealed against the outer sides of the tray.

What is claimed is:

1. A carton blank comprising:

a bottom;

side walls;

end walls; and a lid hingedly attached to one of said side walls or one of said end walls, said side walls or said end walls having corner flaps projecting therefrom, wherein said side walls and said end walls are foldable along crease lines and lockable in a folded state by locking means, said locking means comprising:

an insertion flap with a locking tongue formed on one of said corner flaps, said locking tongue being an S-shaped slit disposed substantially parallel to the crease line of said end walls; and an insertion opening having an edge which cooperates with said locking tongue, said opening being disposed at a corner area of the end wall adjacent to said insertion flap and being stamped out from said blank, said edge of said opening being disposed adjacent an outer end edge of said adjacent end wall.

2. A carton blank as claimed in claim 1, wherein said opening has a predetermined width in the range of 3–5 mm.

3. A carton blank as claimed in claim 2, wherein said opening extends to a width in the range of 5–8 mm near the outer edge of said adjacent end wall.

4. A carton blank comprising:

a bottom;

side walls;

end walls; and a lid hingedly attached to one of said side walls or one of said end walls, said side walls or said end walls having corner flaps projecting therefrom, wherein said side walls and said end walls are foldable along crease lines and lockable in a folded state by locking means, said locking means comprising:

an insertion flap with a locking tongue formed on one of said corner flaps; and an insertion opening having an edge which cooperates with said locking tongue, said opening being disposed at a corner area of the end wall adjacent to said insertion flap and being stamped out from said blank, wherein said opening merges into a slit terminating at the crease line of said adjacent end wall, said edge of said opening being disposed adjacent an outer end edge said adjacent end wall.

5. A carton blank as claimed in claim 4, wherein said opening has a predetermined width in the range of 3–5 mm.

6. A carton blank as claimed in claim 5, wherein said opening extends to a width in the range of 5–8 mm near the outer edge of said adjacent end wall.

* * * * *